US008763398B1

(12) United States Patent
Kalina

(10) Patent No.: US 8,763,398 B1
(45) Date of Patent: Jul. 1, 2014

(54) METHODS AND SYSTEMS FOR OPTIMIZING THE PERFORMANCE OF RANKINE POWER SYSTEM CYCLES

(71) Applicant: Kalex, LLC, Belmont, CA (US)

(72) Inventor: Alexander I. Kalina, Hillsborough, CA (US)

(73) Assignee: Kalex, LLC, Belmont, CA (US)

( * ) Notice: Subject to any disclaimer, the term of this patent is extended or adjusted under 35 U.S.C. 154(b) by 0 days.

(21) Appl. No.: 13/961,476

(22) Filed: Aug. 7, 2013

(51) Int. Cl.
*F01K 25/06* (2006.01)
*F01K 25/08* (2006.01)

(52) U.S. Cl.
USPC ..... 60/649; 60/651; 60/671; 60/673; 60/661; 60/664; 60/665

(58) Field of Classification Search
USPC ..... 60/649, 651, 660, 661, 664, 665, 671, 60/673
See application file for complete search history.

(56) References Cited

U.S. PATENT DOCUMENTS

| | | | | | |
|---|---|---|---|---|---|
| 3,413,809 | A * | 12/1968 | Bredtschneider et al. | ..... | 60/667 |
| 3,636,706 | A * | 1/1972 | Minto | ..... | 60/651 |
| 4,267,458 | A * | 5/1981 | Uram et al. | ..... | 290/40 R |
| 4,471,620 | A * | 9/1984 | Binstock et al. | ..... | 60/653 |
| 4,489,562 | A * | 12/1984 | Snyder et al. | ..... | 60/667 |
| 4,561,254 | A * | 12/1985 | Martens et al. | ..... | 60/660 |
| 7,458,218 | B2 * | 12/2008 | Kalina | ..... | 60/649 |
| 7,685,821 | B2 * | 3/2010 | Kalina | ..... | 60/649 |
| 8,613,196 | B2 * | 12/2013 | Kalina | ..... | 60/673 |

* cited by examiner

*Primary Examiner* — Hoang Nguyen
(74) *Attorney, Agent, or Firm* — Robert W Strozier

(57) ABSTRACT

A optimized organic thermodynamic cycle system and method include temperature sensors measuring an initial temperature of a coolant medium and a final temperature of a heat source stream to computer control valves to continuously adjust a pressure and a flow rate of a working fluid stream to be vaporized so that a heat utilization of the system is about 99% increasing output by approximately 3% to 6% on a sustained and permanent yearly basis.

16 Claims, 3 Drawing Sheets

METHODS AND SYSTEMS FOR OPTIMIZING THE PERFORMANCE OF RANKINE POWER SYSTEM CYCLES

BACKGROUND OF THE INVENTION

1. Field of the Invention

Embodiments of the present invention relate to optimized power systems that utilize geothermal heat sources.

More specifically, embodiments of the present invention relate to optimized binary power systems called organic Rankine cycles (ORCs) utilizing a flow of geothermal fluid as a heat source.

2. Description of the Related Art

Typical geothermal fluids or geofluids are highly mineralized, which limits the minimum temperature to which the geofluids may be cooled to provide heat for a geothermal power system. If it is cooled further than this limit, the minerals in the geofluids will deposit on heat exchange apparatus surfaces or other surfaces in contact with the geofluids, fouling them and interfering with the operation of the power system.

At the same time, the greater the degree of utilization of the heat source stream (i.e., the closer the final temperature of the heat source stream is to the minimum temperature limit imposed by the geofluids mineralization) the higher the output of the system.

However, all actual power systems in current operation do not work so as to make maximum allowable utilization of their heat sources. This is because the temperature of the cooling medium (air or water) varies over the course of each day, as well as by season and in response to the weather. Thus, the working fluid enters and exits the system's feed pump with different temperatures, depending on the coolant temperature.

All of the heat available from a given heat source may be conceptually divided into two portions; the heat used for the vaporization of the working fluid and the heat used for the pre-heating of the working fluid from the temperature at the point just after the feed pump up to the boiling temperature of the working fluid.

In real-world operation, the systems must operate so that, even on the coldest day (corresponding to the coldest possible temperature of the cooling medium), the exit temperature of the heat source always remains above the limit imposed by issues of mineralization.

Therefore, in real-world operations of a power system, the parameters are chosen so that the final temperature of the heat source stream will be measurably higher than the limit imposed by mineralization in all cases, where the temperature of the cooling medium is higher than the coldest it can be. As a result, in an actual installation, most of the time the heat source is not fully utilized.

Thus, there is a need in the art for optimized systems utilizing geothermal fluids (geofluids) as a heat source.

SUMMARY OF THE INVENTION

Embodiments of the present invention provide methods for optimizing the operation of geothermal power systems so that the utilization of the heat source is maximized at all possible coolant temperatures. In certain embodiments, the methods based on binary power systems or so called organic Rankine cycles (ORCs).

Embodiments of the present invention provide apparatuses for optimizing the operation of geothermal power systems so that the utilization of the heat source is maximized at all possible coolant temperatures. In certain embodiments, the apparatuses are binary power systems or so call organic Rankine cycles (ORCs).

BRIEF DESCRIPTION OF THE DRAWINGS

The invention can be better understood with reference to the following detailed description together with the appended illustrative drawings in which like elements are numbered the same.

DEFINITIONS USED IN THE INVENTION

Figure 1:
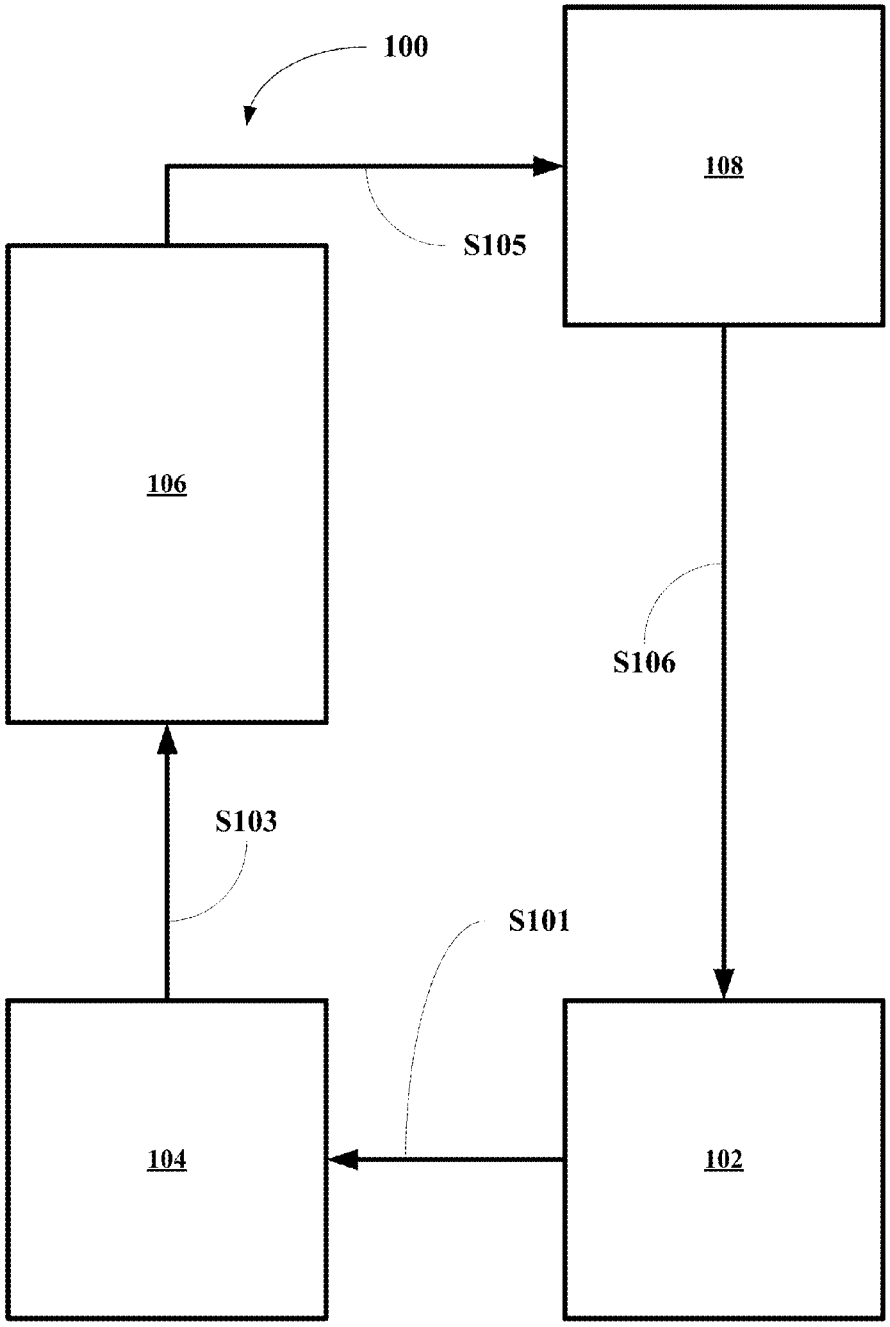
FIG. 1 depicts an embodiment of an optimized power generation system using geofluids.

The term "substantially" means that the value of the value or property that the term modifies is within about 10% of the related value or property. In other embodiments, the term means that the value or property is withing 5% of the related value or property. In other embodiments, the term means that the value or property is withing 2.5% of the related value or property. In other embodiments, the term means that the value or property is withing 1% of the related value or property.

DETAILED DESCRIPTION OF THE INVENTION

The inventor has found that a pressures optimized thermodynamic cycle, in particular, a pressure optimized Rankine cycle may be implemented, where the methods and apparatuses establishing the cycle continuously monitors and adjusts a boiling pressure and flow rate of the working fluid stream entering the vaporization subsystem based on a final temperature of a heat source stream and the initial temperature of a coolant stream. In order to attain this optimum set of parameters for the power systems of this invention, it is necessary to vary the boiling pressure and the flow rate of the working fluid, based on the coolant temperature. However, the work done by the feed pump is such that, for any given difference in pressure between the stream at a location before and after the feed pump, there is one specific and invariable flow rate of the working fluid through the system. At the same time, the flow rate required for the optimal operation of the power systems of this invention at a given pressure is not the same as the actual flow rate that that given pressure inevitably corresponds to. Thus, in order to achieve the optimal operation of the power systems of this invention, it is necessary to have the capability to change the pressure and flow rate separately and independent of each other.

Suitable Reagents and Equipment

The working fluids used in the systems of this invention are either single-component fluids or multi-component fluids. The multi-component fluids comprise at least one lower boiling point component and at least one higher boiling point component. Suitable multi-components fluids include, without limitation, ammonia-water mixtures, mixtures of two or more hydrocarbons, mixtures of two or more freon, mixtures of hydrocarbons and freons, or mixtures thereof. In general, the fluid may comprise mixtures of any number of compounds with favorable thermodynamic characteristics and solubility. In certain embodiments, the multi-component fluid comprises a mixture of water and ammonia.

It should be recognized by an ordinary artisan that at those points in the systems of this invention were a stream is split into two or more sub-streams, dividing valves that affect such stream splitting are well known in the art and may be manually adjustable or dynamically adjustable so that the splitting achieves the desired stream flow rates and system efficiencies. Similarly, when stream are combined, combining valve that affect combining are also well known in the art and may be manually adjustable or dynamically adjustable so that the splitting achieves the desired stream flow rates and system efficiencies.

Specific Embodiments

Referring now to FIG. 1, an embodiment of this invention, generally 100, is shown to include: (a) a condenser subsystem 102 comprising at least one first heat exchange unit, (b) a working fluid pressure and flow control subsystem 104 comprising at least a feed pump, a control valve, a bypass valve, a first temperature sensor, a second temperature sensor, a digital or analog processing unit, a dividing valve, combining valve and a processing unit, (c) a vaporization or boiling subsystem 106 comprising at least one heat exchange unit, and (d) an energy conversion subsystem 108 comprising at least one turbine. Both the control valve and the bypass valve are flow control valves and are controlled by the processing unit and are controlled in such a way as to optimize the power output of the system 100 at all coolant temperatures and all heat source temperatures. The feed pump has a capacity that is maximized for a maximum possible flow rate for any given pressure, where the pressure is greater than what is required to attain optimal operation of the power system 100. It should be noted that the systems of this invention utilize a working fluid stream and all the streams in the systems have the same working fluid composition. Therefore, the term "stream" refers to a working fluid stream and is to be understood in that manner throughout the descriptions set forth below.

The condensation subsystem 102 condenses a spent working fluid stream S106 to form a condensed working fluid stream S101. In certain embodiments, the stream S101 is fully condensed. The stream S101 enters the flow control subsystem 104 to produce a flow and pressure controlled stream S103. The flow controlled stream S103 is then forwarded to vaporization and boiler subsystem 106, where the flow controlled stream S103 is vaporized or fully vaporized or fully vaporized and superheated to form a vaporized stream or a fully vaporized stream or a fully vaporized and superheated stream S105. The stream S105 is then forwarded to the energy conversion subsystem 108, where a portion of its thermal energy is converted to mechanical and/or electrical energy, a usable form of energy to produce a spent stream S106.

Figure 2A:
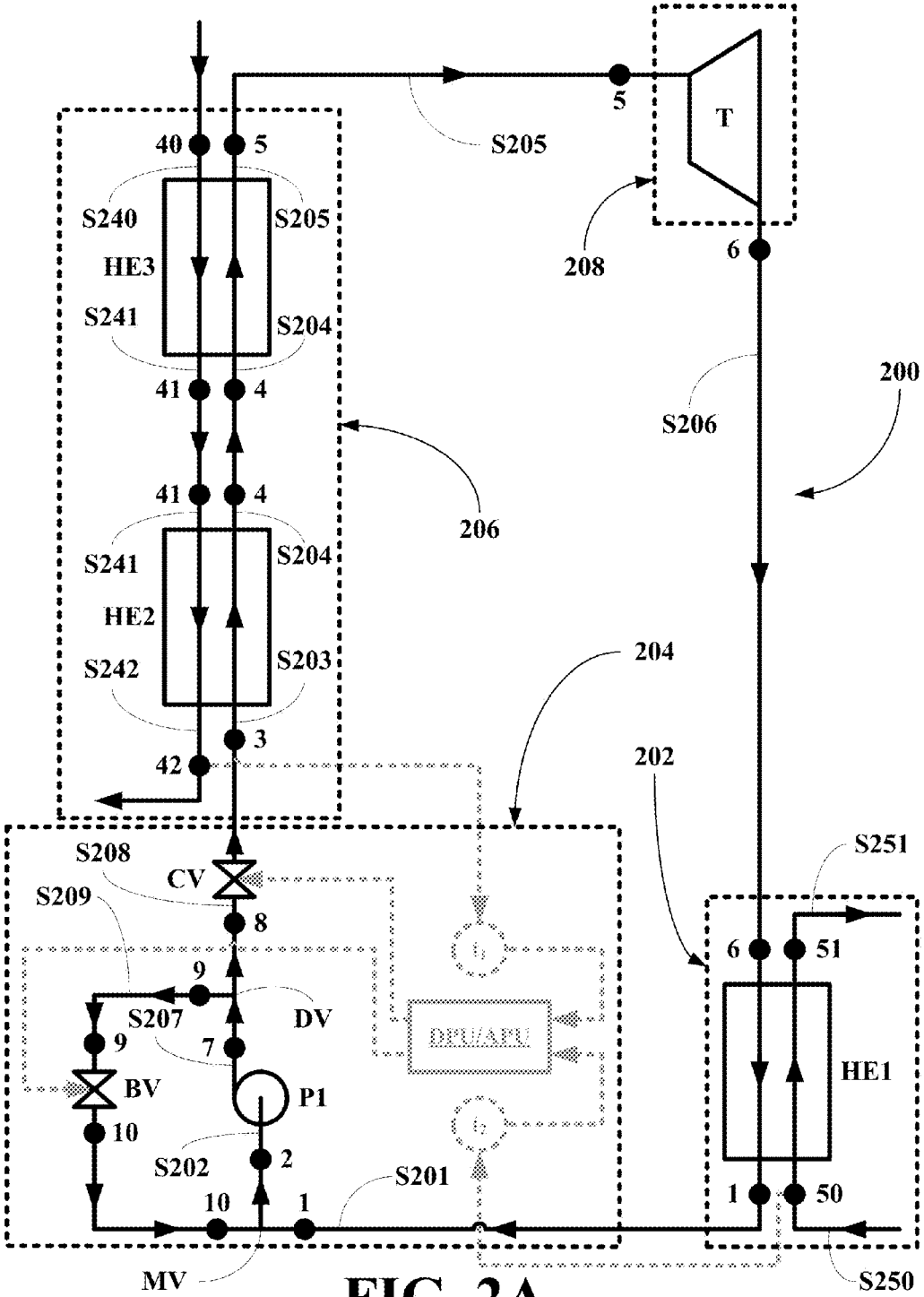
FIG. 2A depicts another embodiment of an optimized power generation system using geofluids.

Referring now to FIG. 2A, an embodiment of this invention, generally 200, is shown to include: (a) a condenser subsystem 202 comprising a first heat exchange unit HE1, (b) a working fluid pressure and flow control subsystem 204 comprising a feed pump P1, a control valve CV, a bypass valve BV, a first temperature sensor $t_1$, a second temperature sensor $t_2$, a digital or analog processing unit (DPU/APU), a dividing valve DV and mixing valve MV, (c) a vaporization or boiling subsystem 206 comprising a second heat exchange unit HE2 and a third heat exchange unit HE3, and (d) an energy conversion subsystem 208 comprising a turbine T. Both the control valve CV and the bypass valve BV are flow control valves and are controlled by the DPU/APU and are controlled in such a way as to optimize the power output of the system 200 at all coolant temperatures and all heat source temperatures. The feed pump P1 has a capacity that is maximized for a maximum possible flow rate for any given pressure, where the pressure is greater than what is required to attain optimal operation of the power system 200. It should be noted that the systems of this invention utilize a working fluid stream and all the streams in the systems have the same working fluid composition. Therefore, the term "stream" refers to a working fluid stream and is to be understood in that manner throughout the descriptions set forth below.

The system 200 operates as follows. A condensed stream S201 having parameters (e.g., pressure, flow rate, temperature, compositions, etc.) as at a point 1 exits the first heat exchange unit HE1. The stream S201 is combined by the mixing valve MV with a pressure adjusted recirculation stream S210 having parameters as at a point 10 forming a feed pump input stream S202 having parameters at as a point 2. A pressure of the feed pump input stream S202 is the same as a pressure of the stream S201 having the parameters as the point 1.

The feed pump input stream S202 is then pumped to a higher pressure in the feed pump P1 to form a pressurized feed pump input stream S207 having parameters as at a point 7. The pressurized feed pump input stream S207 is then forwarded to the control valve CV, where a pressure of the stream S207 is reduced to a desired pressure forming a pressure adjusted stream S203 having parameters as a point 3. The desired pressure of the stream S203 is an optimal pressure for the specific boundary conditions at which the power system 200 operates at any given moment and is set by the DPU/APU, which controls the control valve CV as explained more fully below.

If the entire flow of the stream S207 exiting the pump P1 were to pass through the control valve CV, then a flow rate of the stream S203 having the parameters as at the point 3 would be higher than needed for optimal performance. Thus, the stream S207 is divided by the dividing valve DV into two substreams, a flow rate adjusted stream S208 having parameters as at a point 8 and a diverted or recirculation stream S209 having parameters as at a point 9. The flow rate adjusted stream S208 is then forwarded to the control valve CV to form the stream S203.

The stream S209 is then sent through a bypass valve BV, where its pressure is reduced to a pressure equal to a pressure of the working fluid stream S201 having the parameters as at the point 1 forming the stream S210 having the parameters as at the point 10. The stream S210 is then combined by the mixing valve MV with the stream S201, thereby recirculating the excess working fluid flow of stream S207 through the pump P1 in the form of the combined stream S202.

As a result, a pressure and a flow rate of the pressures adjusted working fluid stream S203 entering a vaporization or boiler subsystem 206 of the system 200 are kept at values that correspond to optimal operation of the system 200.

The optimal pressure of the stream S203 having the parameters at the point 3 is established by the control valve CV. The operation of the control valve CV is controlled by the DPU/APU based on measuring an initial coolant temperature of a cooling media stream S250 having parameters as at a point 50. The initial temperature is measured by a first temperature sensor $t_1$, the response of which is forwarded to the DPU/APU, which in turn uses the initial coolant temperature to control the control valve CV.

The optimal flow rate of stream S203 is independently established by the operation of the bypass valve BV, the operation of which is controlled the DPU/APU based on measuring a final heat source temperature of a spent heat source stream S242 having parameters as at a point 42 exiting the vaporization subsystem 202. The final temperature of the spent heat source stream S242 is measured by the second temperature sensor $t_2$, the response therefrom is forwarded to the DPU/APU, which in turn uses the final temperature of the spent heat source stream S242 to control the flow rate and pressure of the pressure adjusted recirculation stream S210.

The control valve CV is controlled by the operational computer subsystem DPU/APU that measures the cooling media stream initial temperature of the stream S250 having the parameters as at the point 50, which is used to set the pressure and flow rate of the flow rate adjusted stream S203 exiting of the control valve CV. The bypass valve BV may be operated and controlled in the same manner by the operational computer subsystem DPU/APU taking a measurement of the final temperature of the spent heat source stream S142, which is used to set the flow rate of the recirculation stream S209 forwarded to the bypass valve BV. Alternately, since the temperature of the spent heat source stream S242 needs to be constant (being limited by issues of mineralization), the bypass valve BV may be made to be a thermo-regulating valve, which is set to keep the temperature of the spent heat source stream S242 within a required range and thus controls the flow rate through the bypass valve BV. (Any other method of control that attains the same results will serve equally well.)

The flow rate adjusted stream S203 is then forwarded into the vaporization subsystem 206. The stream S203 first enters the second heat exchange unit HE2, where the stream S203 is heated in counterflow with a cooled heat source stream S241 having parameters as at a point 41 to form a heated or a partially vaporized stream S204 having parameters as at a point 4 and a spend heat source stream S242 having parameters as at a point 42. The stream S204 is then forwarded into the third heat exchange system HE3, where the stream S204 is vaporized and/or superheated in counterflow with a heat source stream S240 having parameters as at a point 40 to form a vaporized or superheated stream S205 having parameters as at a point 5 and the cooled heat source stream S241.

The vaporized or superheated stream S205 is then forwarded to the heat conversion subsystem 208. The stream S205 enters the turbine T forming a spent stream S206 having parameters as at a point 6 and a portion of the heat in the stream S205 is extracted and converted to a usable form of energy such as mechanical and/or electrical.

The spent stream S206 is then forwarded to the condenser subsystem 202. The stream S206 enters the condenser HE1, where the stream S206 is condensed in counterflow with a coolant stream S250 having parameters as at a point 50 to form the condensed stream S201 and a spent coolant stream S251 having parameters as at a point 51.

Figure 2B:
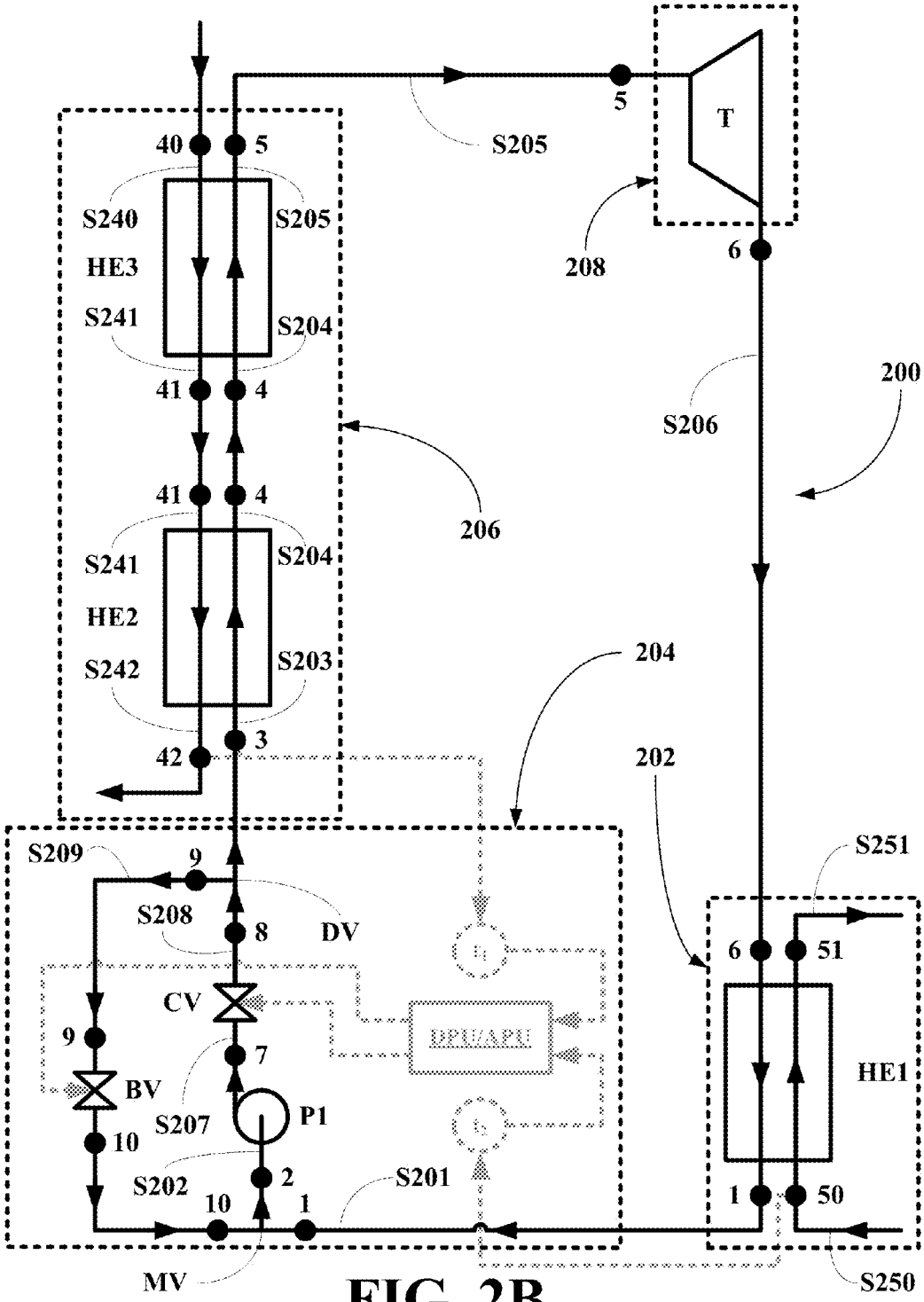
FIG. 2B depicts another embodiment of an optimized power generation system using geofluids.

Referring now to FIG. 2B, another embodiment of the present system 200 comprises an alternate arrangement of the control valve CV, the bypass valve BV, the dividing valve DV and the mixing valve MV. The pressurized feed pump input stream S207 in this variant is feed directly into the control valve CV to form a pressure adjusted stream S208. In this variant, the pressure adjusted stream S208 exiting the control valve CV is divided by the dividing valve DV to from the flow adjusted stream S203 and the recirculation stream S209, which is then feed to the bypass valve BV to from the pressure adjusted recirculation stream S210. In this variant, the operation of the bypass valve BV does not affect the operation of the control valve CV; this lack of feedback has advantages, in terms of stability, but also disadvantages, due to the lack of feedback. However, either variant is viable.

Calculations show that over the course of an average year of operation of an ORC geothermal power system of the prior art convert approximately 90% to 95% of the total available heat potential is utilized, while using the present inventions, either variant, will allow an increase in the heat utilization to about 99% of the total available heat potential, increasing output by approximately 3% to 6% on a sustained and permanent yearly basis.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

I claim:

1. A system for implement a thermodynamic cycle comprising:

a condenser subsystem comprising at least one first heat exchange unit that condenses a spent working fluid stream to form a condensed working fluid stream, a working fluid pressure and flow control subsystem comprising at least a feed pump, a control valve, a bypass valve, a first temperature sensor, a second temperature sensor, a processing unit, a dividing valve, mixing valve and a processing unit that produces a flow rate and pressure adjusted vaporization subsystem input stream from the condensed working fluid stream, a vaporization or boiling subsystem comprising at least one heat exchange unit that vaporizes the flow rate and pressure adjusted vaporization subsystem input stream to form a vaporized energy conversion subsystem input stream, and an energy conversion subsystem comprising at least one turbine that extracts a portion of thermal energy from the vaporized energy conversion subsystem input stream to form the spent working fluid stream, where the control valve and the bypass valve are flow control valves and are controlled by the processing unit controlled in such a way as to optimize the pressure and flow rate of the flow rate and pressure adjusted vaporization subsystem input stream optimizing a power output of the system based on an initial coolant temperature and a final heat source temperature and where the system increases a heat utilization to about 99% of the total available heat potential, increasing output by approximately 3% to 6% on a sustained and permanent yearly basis.

2. The system of claim 1, wherein:

the mixing valve combines the condensed working fluid stream and a pressure adjusted recirculation stream exiting the bypass valve to form a feed pump input stream, the feed pump pumps the feed pump input stream to a higher pressure to form a pressurized stream, the dividing valve divides the pressurized stream into a control valve input stream and a recirculation stream, the control valve adjusts a pressure and a flow rate of the control valve input stream to form the flow rate and pressure adjusted vaporization subsystem input stream, and the bypass valve adjusts a pressure and a flow rate of the recirculation stream to form the pressure adjusted recirculation stream.

3. The system of claim 1, wherein the mixing valve combines the condensed working fluid stream and a pressure adjusted recirculation stream exiting the bypass valve to form a feed pump input stream, the feed pump pumps the feed pump input stream to a higher pressure to form a pressurized control valve input stream, the control valve adjusts a pressure and a flow rate of the pressurized control valve input stream to form a pressure adjusted stream, the dividing valve divides the pressurized adjusted stream into the flow rate and pressure adjusted vaporization subsystem input stream and a recirculation stream, and the bypass valve adjusts a pressure and a flow rate of the recirculation stream to form the pressure adjusted recirculation stream.

4. The system of claim 1, wherein the working fluid is a single-component fluid.

5. The system of claim 1, wherein the working fluid comprises a multi-component fluid.

6. The system of claim 5, wherein the multi-component fluid comprises at least one lower boiling point component and at least one higher boiling point component.

7. The system of claim 6, wherein the multi-component fluid comprises an ammonia-water mixture, a mixture of two or more hydrocarbons, a mixture of two or more freon, a mixture of hydrocarbons and freons, or mixtures thereof.

8. The system of claim 7, wherein the multi-component fluid comprises a mixture of water and ammonia.

9. A method for implement a thermodynamic cycle comprising the steps of:

condensing a spent working fluid stream in a condenser subsystem comprising at least one first heat exchange unit to form a condensed working fluid stream, producing a vaporization subsystem input stream in a working fluid pressure and flow control subsystem comprising at least a feed pump, a control valve, a bypass valve, a first temperature sensor, a second temperature sensor, a processing unit, a dividing valve, mixing valve and a processing unit from the condensed working fluid stream, vaporizing the vaporization subsystem input stream in a vaporization or boiling subsystem comprising at least one heat exchange unit to form a vaporized energy conversion subsystem input stream, and converting a portion of the thermal energy in the vaporized energy conversion subsystem input stream in an energy conversion subsystem comprising at least one turbine to form the spent working fluid stream, where the control valve and the bypass valve are flow control valves and are controlled by the processing unit controlled in such a way as to optimize the pressure and flow rate of the flow rate and pressure adjusted vaporization subsystem input stream optimizing a power output of the system based on an initial coolant temperature and a final heat source temperature and where the system increases a heat utilization to about 99% of the total available heat potential, increasing output by approximately 3% to 6% on a sustained and permanent yearly basis.

10. The method of claim 9, wherein:

combining the condensed working fluid stream and a pressure adjusted recirculation stream exiting the bypass valve in the mixing valve to form a feed pump input stream, pumping the feed pump input stream to a higher pressure in the feed pump to form a pressurized stream, dividing the pressurized stream into a control valve input stream and a recirculation stream in the dividing valve, adjusting a pressure and a flow rate of the control valve input stream in the control valve to form the vaporization subsystem input stream, and adjusting a pressure and a flow rate of the recirculation stream in the bypass valve to form the pressure adjusted recirculation stream.

11. The method of claim 9, wherein:

mixing the condensed working fluid stream and a pressure adjusted recirculation stream exiting the bypass valve in the mixing valve to form a feed pump input stream, pumping the feed pump input stream to a higher pressure in the feed pump to form a pressurized control valve input stream, adjusting a pressure and a flow rate of the pressurized control valve input stream in the control valve to form a pressure adjusted stream, dividing the pressure adjusted stream in the dividing valve into the vaporization subsystem input stream and a recirculation stream, and adjusting a pressure and a flow rate of the recirculation stream in the bypass valve to form the pressure adjusted recirculation stream.

12. The method of claim 9, wherein the working fluid is a single-component fluid.

13. The method of claim 9, wherein the working fluid comprises a multi-component fluid.

14. The method of claim 13, wherein the multi-component fluid comprises at least one lower boiling point component and at least one higher boiling point component.

15. The method of claim 14, wherein the multi-component fluid comprises an ammonia-water mixture, a mixture of two or more hydrocarbons, a mixture of two or more freon, a mixture of hydrocarbons and freons, or mixtures thereof.

16. The system of claim 15, wherein the multi-component fluid comprises a mixture of water and ammonia.

* * * * *